US008844927B2

(12) United States Patent
Hazu et al.

(10) Patent No.: US 8,844,927 B2
(45) Date of Patent: Sep. 30, 2014

(54) SHEET LOADING APPARATUS, ERASING APPARATUS, AND SHEET LOADING METHOD

(75) Inventors: Hiroyuki Hazu, Shizuoka-ken (JP); Ken Iguchi, Shizuoka-ken (JP); Yuichi Saito, Shizuoka-ken (JP); Isao Yahata, Shizuoka-ken (JP); Takahiro Kawaguchi, Shizuoka-ken (JP); Yoshiaki Sugizaki, Shizuoka-ken (JP); Kikuo Mizutani, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Yoichi Yamaguchi, Shizuoka-ken (JP); Hiroyuki Sugiyama, Shizuoka-ken (JP); Jun Ishii, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 287 days.

(21) Appl. No.: 13/534,955

(22) Filed: Jun. 27, 2012

(65) Prior Publication Data

US 2013/0003134 A1 Jan. 3, 2013

Related U.S. Application Data

(60) Provisional application No. 61/533,151, filed on Sep. 9, 2011, provisional application No. 61/503,573, filed on Jun. 30, 2011, provisional application No. 61/533,175, filed on Sep. 9, 2011.

(30) Foreign Application Priority Data

May 24, 2012 (JP) ..... P2012-118231

(51) Int. Cl.
*B65H 31/36* (2006.01)
*B65H 31/10* (2006.01)

(52) U.S. Cl.
CPC ..... *B65H 31/10* (2013.01); *B65H 2405/1117* (2013.01); *B65H 2511/222* (2013.01); *B65H 31/36* (2013.01); *B65H 2405/11152* (2013.01); *B65H 2404/1521* (2013.01); *B65H 2511/212* (2013.01); *B65H 2511/152* (2013.01)
USPC ..... 271/220; 271/3.02; 270/58.27

(58) Field of Classification Search
USPC ..... 271/220, 3.02; 270/58.27
See application file for complete search history.

(56) References Cited

U.S. PATENT DOCUMENTS 5,199,703 A * 4/1993 Hess ..... 271/314
5,284,338 A * 2/1994 Allmendinger et al. ..... 271/220

(Continued)

FOREIGN PATENT DOCUMENTS

JP H07-172672 7/1995
JP 2009-046290 3/2009

OTHER PUBLICATIONS

English Translation of Office Action dated Mar. 11, 2014, filed in corresponding Japanese Patent Application No. 2012-118231.

*Primary Examiner* — Ernesto Suarez
(74) *Attorney, Agent, or Firm* — Patterson & Sheridan LLP

(57) ABSTRACT

A sheet loading apparatus includes a loading member which loads the sheet discharged by the discharge member, a tip support member which abuts against the leading edge of the sheet discharged by the discharge member in the sheet discharge direction, a rotation member which abuts against an upper surface of the sheet discharged to the loading member, and is rotated to transport the sheet to the stopper side, and a control section which controls a transport amount of the sheet through the rotation member based on a loading amount of the sheet loaded on the loading member.

15 Claims, 7 Drawing Sheets

(56) References Cited

U.S. PATENT DOCUMENTS

| | | | | |
|---|---|---|---|---|
| 5,338,022 | A * | 8/1994 | Funk et al. | 271/184 |
| 6,910,688 | B2 * | 6/2005 | Saito et al. | 271/220 |
| 7,527,260 | B2 * | 5/2009 | Moore | 271/176 |
| 7,891,652 | B2 * | 2/2011 | Mandel et al. | 270/58.17 |
| 7,942,407 | B2 * | 5/2011 | Someya et al. | 271/220 |
| 8,260,188 | B2 * | 9/2012 | Yahata et al. | 399/411 |
| 2004/0070141 | A1 * | 4/2004 | Michels et al. | 271/220 |
| 2010/0321457 | A1 * | 12/2010 | Kawaguchi et al. | 347/179 |
| 2011/0211033 | A1 | 9/2011 | Yahata et al. | |
| 2011/0317198 | A1 * | 12/2011 | Suzuki | 358/1.13 |

* cited by examiner

SHEET LOADING APPARATUS, ERASING APPARATUS, AND SHEET LOADING METHOD

CROSS-REFERENCE TO RELATED APPLICATIONS

This application is based upon and claims the benefit of priority from the prior the U.S. Patent Application No. 61/503,573, filed on Jun. 30, 2011, and the prior the U.S. Patent Application No. 61/533,175, filed on Sep. 9, 2011, and the prior the U.S. Patent Application No. 61/533,151, filed on Sep. 9, 2011, and Japanese Patent Application No 2012-118231, filed on May 24, 2012, and the entire contents all of which are incorporated herein by reference.

FIELD

Embodiments described herein relate generally to a sheet loading apparatus which improves loading properties of sheets that are output to a discharge section, an erasing apparatus, and a sheet loading method.

BACKGROUND

There is a sheet loading apparatus which discharges and loads sheets subjected to processing such as printing or stapling. The sheet loading apparatus includes a paper discharge tray which loads discharged sheets. The paper discharge tray has a shape in which an upstream side thereof in a transport direction slopes downward, and has a configuration in which discharged sheets return to the upstream side after being discharged onto the paper discharge tray, and the back end of the sheets abuts against a wall surface of an apparatus main body.

Meanwhile, there is an erasing apparatus which erases images formed on the sheets and makes the sheets reusable. The erasing apparatus includes an erasing section which erases images formed on the sheets, and a loading tray which loads the erased and reusable sheets. The sheets loaded on the loading tray are set on a paper feeding cassette of an image forming apparatus after being removed by a user.

In the paper discharge tray of the sheet loading apparatus as mentioned above, when a sheet on the paper discharge tray returns to the upstream side, there has been a problem in that the next discharged sheet comes into contact with the sheet on the paper discharge tray, the sheet does not return to a fixed position, and the alignment of the sheets is degraded.

Furthermore, in the erasing apparatus as mentioned above, it was required that a user aligns sheet deviation after removing the sheets from the loading tray, and then sets the sheets on the image forming apparatus. For this reason, there is a need for an apparatus which loads the reusable sheets in a satisfactorily aligned state.

DETAILED DESCRIPTION

Hereinafter, exemplary embodiments will be described with reference to the drawings.

First Embodiment

According to the embodiment, a sheet loading apparatus includes a discharge member which discharges sheets, a loading member which loads the sheets discharged by the discharge member, a tip support member which is provided in the downstream of the loading member in a sheet discharge direction and abuts against the leading edge of the sheet discharged by the discharge member in the sheet discharge direction, a rotation member which is provided above the loading member, abuts against an upper surface of the sheet discharged to the loading member, is rotated and transports the sheet to the stopper side, and a control section which controls a transport amount of the sheet through the rotation member based on a loading amount of the sheet loaded on the loading member.

Figure 1:
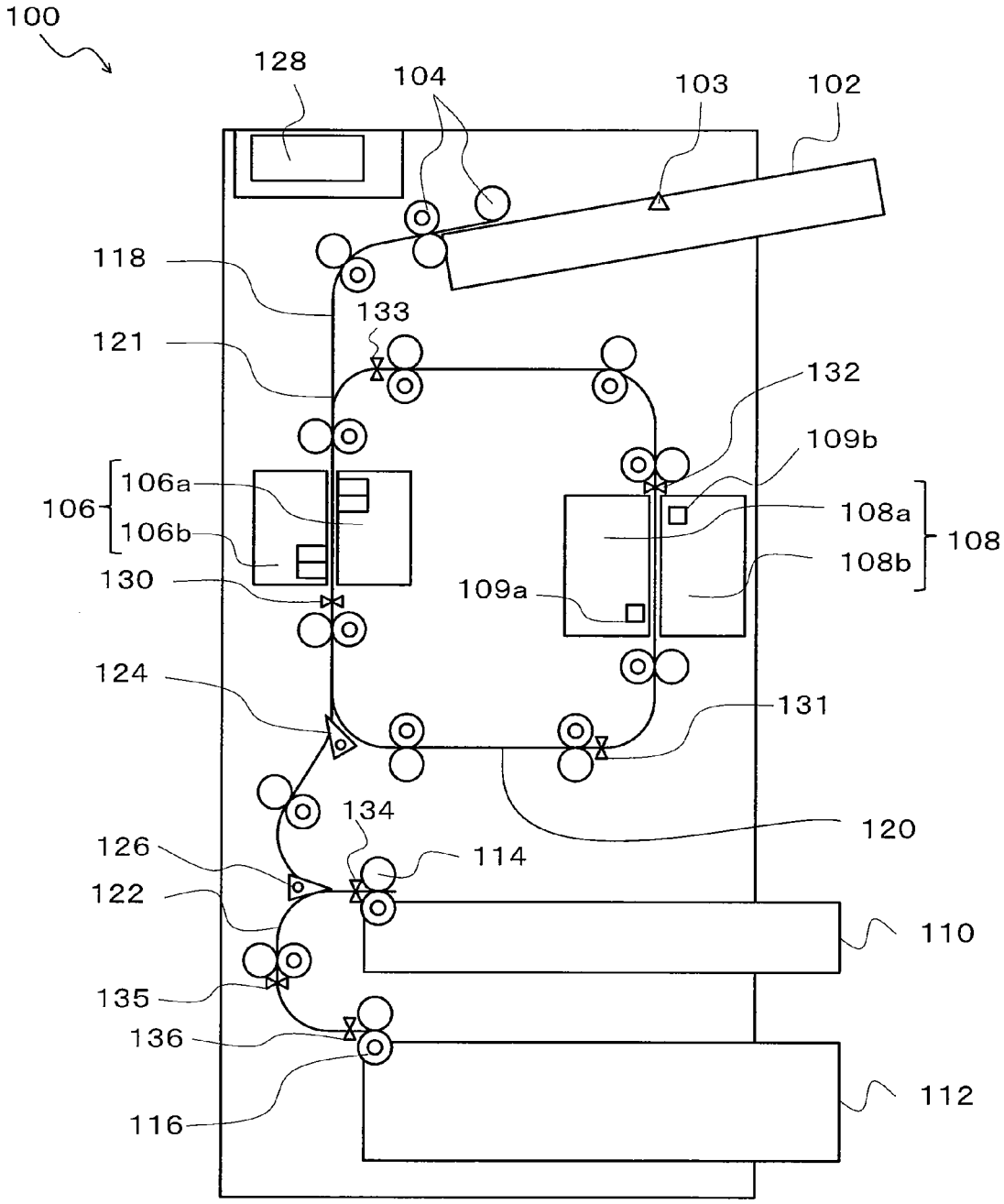
FIG. 1 is a schematic diagram that describes a configuration of an erasing apparatus of a first embodiment.

FIG. 1 is a schematic diagram that describes a configuration of an erasing (decolorizing) apparatus (or a sheet loading apparatus). The erasing apparatus 100 performs "color erasing processing (or decolorizing process)" which erases the color of an image due to color-erasable material with respect to the sheet formed with the image using "a color-erasable material" such as a color-erasable toner or a color-erasable ink. The color-erasable material includes a color change compound, a developer, and a decolorant. The color change compound includes, for example, a leuco dye. The developer includes, for example, phenols. The decolorant includes a substance which is dissolved with the color change compound when being heated and has no affinity with the developer. The color-erasable material generates the color as a result of an interaction between the color-erasable material, and the color change compound and the developer. Since the interaction between the color change compound and the developer is severed by heating to equal to or greater than a color erasing temperature, and thus the color-erasable material performs the color erasing processing. Hereinafter, the color-erasable material is simply called a recording medium.

The erasing apparatus 100 includes a paper feeding tray 102, a paper feeding member 104, a reading section 106, an easing section 108, a first tray 110, a second tray 112, discharge rollers 114 and 116, a first transport path 118, a second transport path 120, a third transport path 122, a first branch member 124, a second branch member 126, and an operation section 128.

The paper feeding tray 102 loads a paper for reuse. The paper feeding tray 102 loads sheets of various sizes such as A4, A3 and B5. The sheet loaded by the paper feeding tray 102 is, for example, a sheet formed with an image by a recording material that performs the color erasing processing by being heated to a predetermined temperature or more. The paper feeding member 104 has a pickup roller, a sheet supply roller, and a separation roller placed against the sheet supply roller or the like, and supplies the sheet on the paper feeding tray 102 to the first transport path 118 in the erasing apparatus 100 one by one. Furthermore, the paper feeding tray 102 has a detection sensor 103 which detects the presence or absence of the sheet on the paper feeding tray 102. The detection sensor 103, for example, may be a micro sensor and a micro actuator. The first transport path 118 forms a transport path which faces from the paper feeding tray 102 to the first tray 110. The first transport path 118 transports the fed sheet to the reading section 106 or the first tray 110.

The reading section 106 is placed along the first transport path 118 on the downstream side in the sheet transport direction with respect to the paper feeding tray 102. The reading section 106 has, for example, a reading unit such as a CCD (Charge Coupled Device) scanner or a CMOS sensor. In the present embodiment, the reading section 106 reads the respective images of the first surface and the second surface of the transported sheet. That is, the reading section 106 is constituted by a first reading unit 106*a* and a second reading unit 106*b* placed along the first transport path 118 with the transport path interposed therebetween, and allows double-sided reading of the image of the transported sheet. A reading position where the reading unit of the reading section 106 reads the image of the sheet is called a reading position. The image read by the reading section 106 is stored in a memory section 210 (see FIG. 2) described below. For example, the reading section 106 computerizes the image on the sheet read by the reading section 106 and stores the image in the memory section before color erasing processing, whereby when there is a need, at a later point, for data of the image erased, the image data can be acquired. Furthermore, a control section 200 described below determines whether or not the sheet is color-erasable or reusable, based on the image read by the reading section 106.

On the downstream of the reading section 106, a first branch member 124 is provided as a switch section. The first branch member 124 switches the transport direction of the transported sheet. The first branch member 124 transports the sheet transported through first transport path 118 to the second transport path 120 or the first tray 110. The second transport path 120 is branched from the first transport path 118 at a branch point with the first branch member 124 placed thereon. The second transport path 120 branched from the branch point transports the sheet to the erasing section 108. Furthermore, the second transport path 120 joins the first transport path 118 at a junction point 121 on the upstream in the sheet transport direction from the reading section 106. That is, the second transport path 120 joins the first transport path 118 in a junction point 121 between the paper feeding tray 102 and the reading section 106. Thus, the second transport path 120 is able to transport the sheet transported from the reading section 106 via the erasing section 108 to the reading section 106 again. In other words, the erasing apparatus 100 is able to transport the sheet supplied from the paper feeding member 104 in an order of the reading section 106, the erasing section 108, and the reading section 106 by controlling the first branch member 124.

The first transport path 118 has a second branch member 126 on the downstream of the first branch member 124. The second branch member 126 guides the sheet transported from the first branch member 124 to the first tray 110 or the third transport path 122. The third transport path 122 transports the sheet to the second tray 112.

The erasing section 108 erases the color of the image of the transported sheet (or decolors the image of the transported sheet). For example, the erasing section 108 erases the color of the images formed on the sheet by the recording medium by heating the sheet up to a predetermined color erasing temperature in the state of being in contact with the transported sheet. For example, the erasing section 108 of the erasing apparatus 100 of the present embodiment has two color erasing processing units 108*a* and 108*b* for a first surface color erasing processing and a second surface color erasing processing of the sheet. The color erasing processing units 108*a* and 108*b* are oppositely placed with the second transport path 120 interposed therebetween. The color erasing processing unit 108*a* abuts against the sheet from one surface of the sheet to heat the sheet. The color erasing processing unit 108*b* abuts against the sheet from the other surface of the sheet to heat the sheet. That is, the erasing section 108 erases the images of both sides of the transported sheet in one transport operation. A position where the color erasing processing units 108*a* and 108*b* heat the sheet, that is, a position where heating sections (not shown) included in the color erasing processing units 108*a* and 108*b* apply heat to the transported sheet to erase the colors of the images, is called a color erasing position. The erasing section 108 has temperature sensors 109*a* and 109*b* that detect the temperature of the heating section of the color erasing processing units 108*a* and 108*b*, respectively. The temperature sensors 109*a* and 109*b* may be a contact type or a non-contact type.

The operation section 128 placed over the erasing apparatus 100 main body has a touch panel type display section and various operation keys, and for example, is placed over the erasing apparatus main body. The operation keys include a ten key, a stop key, a start key and the like, for example. A user instructs a functional operation of the erasing apparatus 100 such as the start of the color erasing processing or the reading of the image of the color-erased sheet. The operation section 128 displays the setting information and the operation status of the erasing apparatus 100, the log information or a message to a user. In addition, the operation section 128 is not limited to being placed in the main body of the erasing apparatus 100. For example, the operation section may have a configuration that can be operated from an operation section of an external apparatus connected to the erasing apparatus 100 via a network. Alternatively, the operation section may be a form independent from the erasing apparatus main body, and may be a configuration which operates the erasing apparatus 100 by wired or wireless communication. The operation section of the present embodiment may be a section which is able to perform the instruction of processing, reading of information or the like with respect to the erasing apparatus 100.

The discharge rollers 114 and 116 discharge the sheet to the first tray 110 and the second tray 112 placed vertically below the main body. For example, the first tray 110 loads the reusable sheets on which the image on the sheet has been erased. The second tray 112 loads the sheet determined as not reusable. The first tray 110 will be described as a reuse tray, and the second tray 112 will be described as a reject tray. In addition, the first tray 110 and the second tray 112 are also able to interchange the sheet that becomes the received target. The setting regarding which sheet is loaded on the respective trays, that is, the setting of the transport location of the sheet may be set, for example, from the operation section 128. According to the setting, the second branch member 126 switches the transport path, and guides the transported sheet to the first tray 110 or the third transport path 122.

The erasing apparatus 100 has a plurality of detection sensors 130, 131, 132, 133, 134, 135 and 136 that detect the sheet transported through the first to third transport paths 118, 120, and 122. The sheet detection sensors may be, for example, a micro sensor or a micro actuator. The sheet detection sensors are placed at suitable positions of the transport paths.

Figure 2:
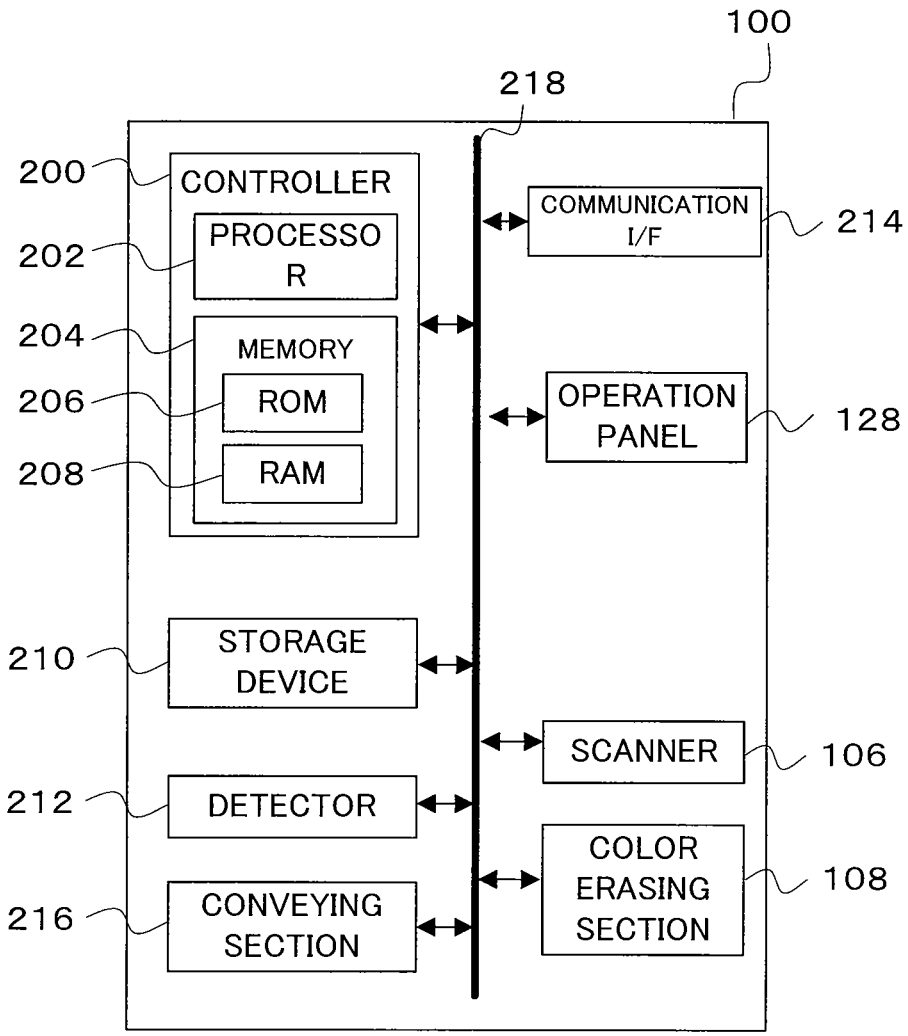
FIG. 2 is a block diagram that describes a hardware configuration of an erasing apparatus of the first embodiment.

FIG. 2 is a block diagram that describes a hardware configuration of the erasing apparatus. The erasing apparatus 100 includes a control section 200, a memory section 210, a detection section 212, a communication interface (a communication I/F) 214, a transport section 216, a reading section 106, an erasing section 108, and an operation section 128.

The control section (controller) 200 includes a processor 202 constituted by a CPU (Central Processing Unit) or a MPU (Micro Processing Unit), and a memory 204. The control section 200 controls the reading section 106, the erasing section 108, and the operation section 128. The memory 204 is, for example, a semiconductor memory, and includes a ROM (Read Only Memory) 206 which stores various control programs, and a RAM (Random Access Memory) 208 which supplies a temporary working area to the processor 202. For example, the ROM 206 stores a print rate of the paper that becomes a threshold value for reuse, a density threshold value for determining whether the image is erased or the like. The RAM 208 may temporally preserve the image that is read by the reading section 106. The respective components of the erasing apparatus 100 are connected to each other via a bus 218.

For example, the erasing apparatus 100 includes the read processing, color erasing processing, sort processing and the pre-sort processing. The control section 200 of the erasing apparatus 100 controls the reading section 106, the erasing section 108, and other configurations depending on the set processing.

In the reading processing, the control section 200 preserves the image that is read by the reading section 106 to the memory section 210 (see FIG. 2). In the color erasing processing, the control section 200 erases the image of the sheet by the erasing section 108.

In the sort processing, the control section 200 determines whether or not the sheet is reusable based on the image that is read by the reading section 106. For example, in the sort processing, the control section 200 determines whether or not there is an image on the sheet based on the data that is read by the reading section 106, and when there is an image, the control section 200 makes the sheet non-reusable. For example, when reading the sheet after the color erasing processing by the reading section 108, if there is a non-erased image, the control section 200 determines that there is an erased residue and reuse is not possible. Furthermore, in the sort processing, the control section 200 determines the presence or absence of wrinkle depth, bends, and splits based on the data that is read by the reading section 106. When the wrinkle depth is equal to or greater than a standard value, and when there is the bend, splits or the hole, the erasing apparatus 100 determines that the reuse is impossible.

In the pre-sort processing, the control section 200 determines the print rate of the image on the sheet based on the data that is read by the reading section 106 before the color erasing processing. When the print rate is equal to or greater than a predetermined threshold value, the control section 200 makes the sheet reusable without executing the color erasing processing. The control section 200 discharges the sheet determined not to be made reusable to the reject tray 112. Alternatively, the control section 200 may determine whether or not prohibition data which needs prohibiting the color erasing processing such as a secret data is included in the data of the sheet image that is read by the reading section 106. When data that needs prohibiting the color erasing processing is included, the control section 200 transports the sheet to the reject tray 112.

The selection of the processing can be set by the operation section 128 of the erasing apparatus 100. In addition, the selection of the executed processing may be set by an external terminal without being limited to the operation section 128 of the erasing apparatus 100. The reading, the color erasing processing, the sort processing or the pre-sort processing mentioned above can be selected in a suitable combination via the operation section 128 or the like. In addition, in the erasing apparatus 100 of the present embodiment, when combining the processing mentioned above, as an example, the reading, the color erasing processing and the sort processing are preferentially executed in this order. Furthermore, the priorities of the reading and the pre-sort processing are equal to each other.

For example, when the reading, the color erasing processing, and the sort processing are selected, the erasing apparatus 100 performs the reading using the reading section 106, the color erasing processing using the erasing section 108, and the sort processing using the reading section 106 in order. That is, before the erasing section 108 erases the image of the sheet, the image of the sheet is read by the reading section 106, and after the erasing section 108 erases the image of the sheet, the reading section 106 reads the image of the erased sheet. When the pre-sort processing, the color erasing processing, and the sort processing are selected, the erasing apparatus 100 performs the pre-sort processing using the reading section 106, the color erasing processing using the erasing section 108, and the sort processing using the reading section 106 in order. When the reading and the pre-sort processing are selected, the erasing apparatus 100 concurrently performs the reading based on the date that is read by the reading section 106, and the pre-sort processing based on the print rate.

In addition, the erasing apparatus 100 is not limited to the suitable selection of the processing mentioned above by a user. For example, the erasing apparatus 100 has a processing mode in which the combination is decided in advance, and may have a configuration in which a user selects the processing mode thereof. The control section 200 of the erasing apparatus 100 suitably changes the transport path of the sheet based on the selected processing.

The control section 200 controls the respective configurations in the apparatus based on the signal from the detection section 212. The detection section 212 includes the detection sensor 103 shown in FIG. 1, the temperature sensors 109*a* and 109*b*, the sheet detection sensors 130 to 136, and a detection sensor that detects the loading amount of the sheet loaded on the first tray 114 and the second tray 116 described later. The control section 200 determines presence or absence of the sheet on the paper feeding tray 102 based on the signal from the detection sensor 103. Furthermore, the control section 200 detects the temperature of the heating section of the color erasing processing units 108*a* and 108*b* using the temperature sensors 109*a* and 109*b*, and controls the temperature of the heating section of the color erasing processing units 108*a* and 108*b*. Furthermore, the control section 200 ascertains the position of the sheet in the first to third transport paths 118, 120 and 122 using the sheet detection sensors 130, 131, 132, 133, 134, 135 and 136. For example, the control section 200 detects the sheet has passed through the reading section 106 using the sheet detection sensor 130 near the downstream of the reading section 106.

The memory section 210 stores the application program and OS. The application program includes program which executes the function of the erasing apparatus such as the reading function using the reading section 106 and the color erasing processing function of the erasing section. The application program includes an application (Web browser) for a Web client and other applications. The memory section 210 preserves the image that is read by the reading section 106. Furthermore, the memory section 210 stores the number of processing of the sheet processed by the erasing apparatus 100. As the memory section 210 may be, for example, a semiconductor memory device such as a hard disk drive and other magnetic memory devices, an optical memory device, and a flash memory or an arbitrary combination thereof.

The communication I/F 214 is an interface that is connected to an external device. The communication I/F 214 communicates with the external equipment on a network via a suitable wireless or wired connection such as IEEE 802.15, IEEE 802.11, IEEE 802.3, and IEEE 3304 such as, Bluetooth (registered trademark), an infrared light connection, or an optical connection. The communication I/F 214 may include an USB connection section and a parallel interface to which a connection terminal of a USB standard is connected. The control section 200 communicates with a multiplier and other external devices via the communication I/F 214. For example, the image, which is read by the reading section 106, may be stored in the memory section 210 of the erasing apparatus 100, but which is not limited. For example, the control section 200 may communicate with a user terminal (personal computer) as the external equipment and a multiplier or a server via the communication I/F 214, and the image maybe saved to the memory section of the external equipment. The image data preserved to the external equipment may be read from the operation section of the multiplier and the user terminal. Furthermore, when the erasing apparatus 100 includes login and logout functions so as to individually identify a user, during logout from the erasing apparatus 100, the data of the image preserved in the RAM 208 of the erasing apparatus 100 or the memory section 210 may be transmitted and preserved to the external device.

The transport section 216 includes a plurality of transport rollers placed in the first transport path 118, the second transport path 120 and the third transport path 122, and a transport motor that drives the transport rollers. The control section 200 controls the transport speed of the sheet by controlling the drive of the transport motor of the transport section 216. Herein, the speed of the sheet transported through the reading section 106 so as to read the image of the sheet is set to a reading speed, and the speed of the sheet transported through the erasing section 108 so as to erase the color of the image of the sheet is set to a color erasing processing speed.

Next, the loading section of the erasing apparatus 100 will be described. The loading section includes the first tray 110 as the reuse tray and the second tray 112 as the reject tray. Hereinafter, the first tray 110 will be described.

Figure 3:
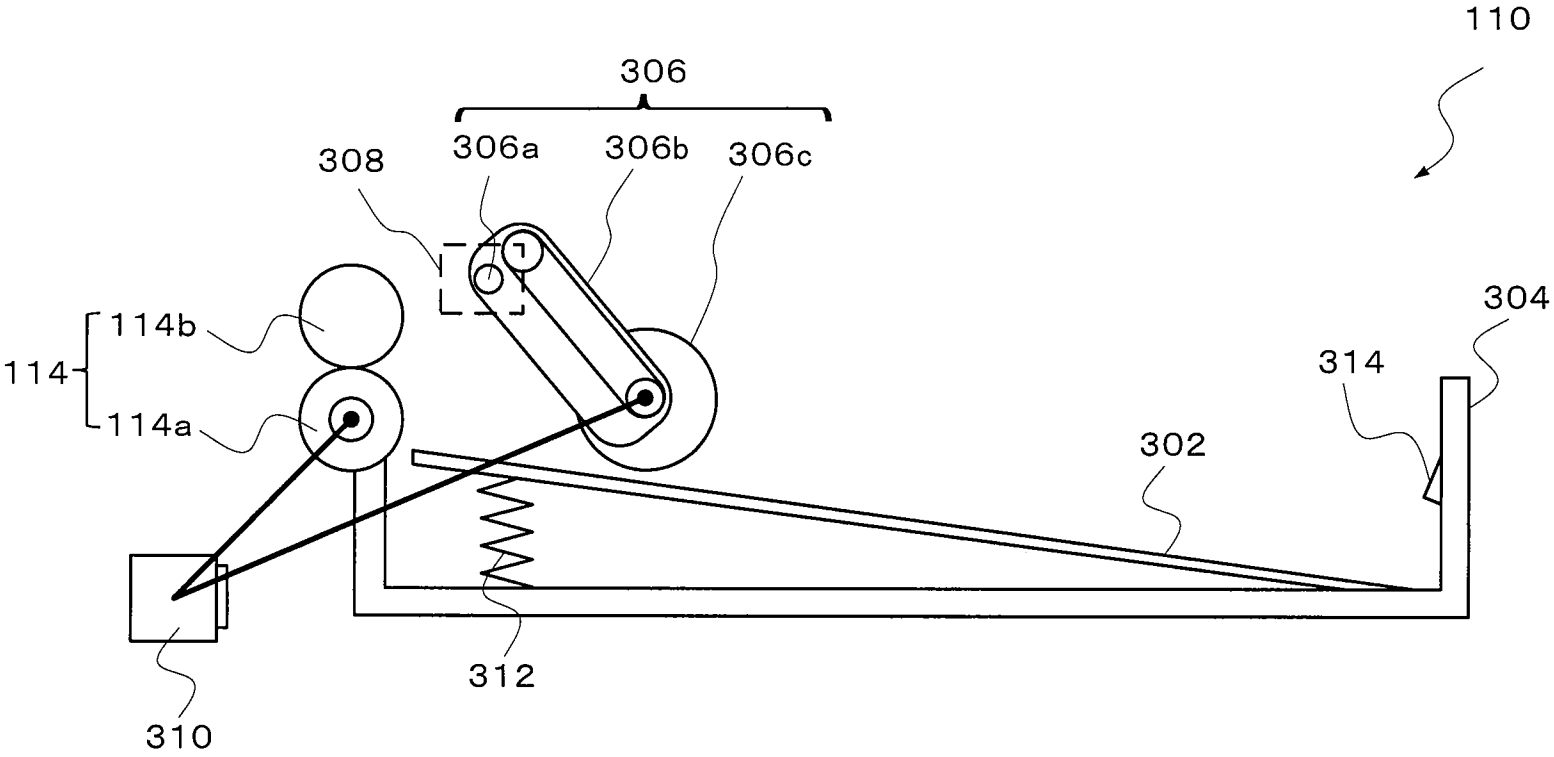
FIG. 3 is a schematic diagram that describes a loading section of the erasing apparatus of the first embodiment.

FIG. 3 is a schematic diagram that describes the first tray 110 which is the loading section of the erasing apparatus 100. The first tray 110 as the loading section of the erasing apparatus 100 includes the discharge roller (a discharge member) 114, a loading tray (a loading member) 302, a stopper (a tip support member) 304, an assist roller 306, a detection sensor (a detection member) 308, and a drive motor 310.

The discharge roller 114 includes a driving roller 114*a* and a driven roller 114*b*, and discharges the sheet to the first tray 110. The loading tray 302 loads the sheet discharged by the discharge roller 114. The loading tray 302 is attached to a bottom section of the first tray 110 via an elastic member 312 and is placed obliquely toward the downstream in the sheet transport direction. The upstream side of loading tray 302 connected to the elastic member 312 in the transport direction is gradually lowered as the sheet is loaded. In addition, the loading tray 302 is not limited to the configuration mentioned above in which the slope angle is gradually reduced according to an increase in the loading amount of the sheet. For example, the slope angle of the loading tray 302 may be fixed, or the slope angle may be absent.

The stopper 304 is provided on the downstream in the sheet transport direction of the first discharge tray 110, and stops the leading edge of the sheet in the transport direction discharged by the discharge roller 114. The stopper 304 may have an elastic member which reduces the impact when the sheet collides.

The assist roller 306 is placed over the loading tray 302, that is, between the discharge roller 114 and the stopper 304. The assist roller 306 includes a swing member 306*b* which is rotated around a rotation shaft 306*a*, and a rotation roller (a rotation member) 306*c* provided on the swing member 306*b*. The assist roller 306 is rotated around the rotation shaft 306*a* by a self weight, and abuts against the upper surface of the sheet discharged to the loading tray 302. The rotation roller 306*c* is rotated to transport the sheet to the stopper 304 side. In addition, the assist roller 306 may have a configuration in which the assist roller 306 is rotated around the rotation shaft 306*a* using a drive source such as a solenoid, and can come into contact with and be separated from the upper surface of the sheet discharged to the loading tray 302. The assist roller 306 functions as a matching member which matches (longitudinally matches) the sheet by causing the sheet discharged by the discharge roller 114 to collide with the stopper 304. The rotation roller 306*c* uses a material having a low friction coefficient, for example, such as a sponge. The drive motor 310 drives the discharge roller 114 and the rotation roller 306*c* of the assist roller 306. In addition, the discharge roller 114 and the assist roller 306 may be driven by the different drive motors, respectively.

Figure 4:
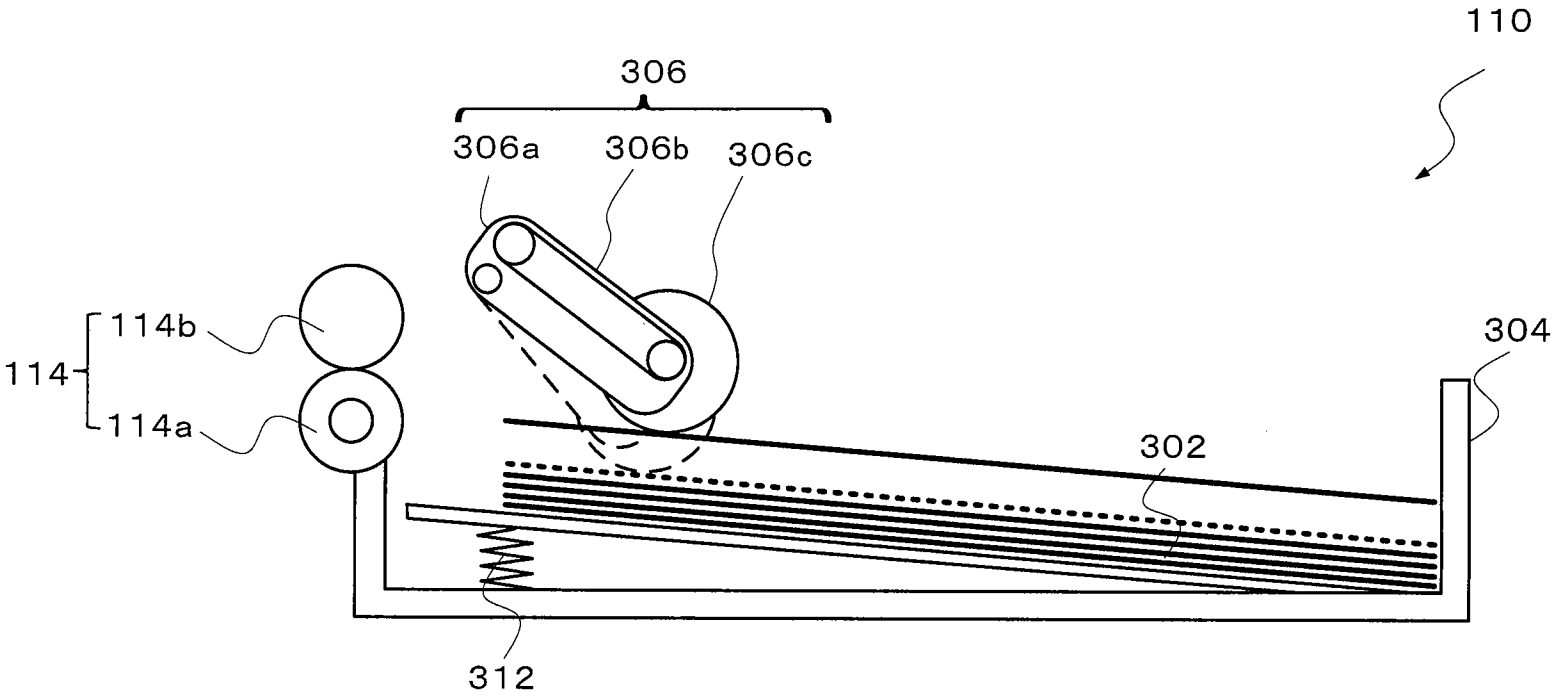
FIG. 4 is a schematic diagram that describes the loading section of the erasing apparatus of the first embodiment.

Herein, as shown in FIG. 4, when the loading amount of the sheet loaded by the loading tray 302 is increased, the assist roller 306 is rotated upward in the drawings. That is, along with a change in the loading amount of the sheet loaded by the loading tray 302, a position (a transport position), where the rotation roller 306*c* of the assist roller 306 comes into contact with the uppermost surface of the sheet loaded by the loading tray 302, is changed. For example, in FIG. 4, along with an increase in the loading amount of the sheet, the transport position of the assist roller 306 is changed to the side of the stopper 304.

Furthermore, when the loading amount of the sheet loaded by the loading tray 302 is increased, the slope of the loading tray 302 or the height or the slope of the uppermost surface of the loaded sheet is changed. Thus, a distance is changed in which the sheet discharged from the discharge roller 114 is moved along the uppermost surface of the loaded sheet.

If the transport amount by which the assist roller 306 transports the sheet, that is, an amount (distance), by which the rotation roller 306 of the assist roller 306 abuts against the sheet discharged from the discharge roller 114 and the sheet is transported is constant, if the loading amount of the sheet is large, as the transport position is changed to the stopper 304 side, that is, as the distance by which the sheet is moved along the uppermost surface of the loaded sheet is short, the assist roller 306 transports the sheet to the stopper 304 side excessively. In this case, the sheet is subjected to buckling or is damaged. Alternatively, there is a concern that the matching properties of the sheet may be degraded.

Thus, the erasing apparatus 100 of the present embodiment controls the transport amount of the sheet using the assist roller based on the loading amount of the sheet loaded by the loading tray 302. When the loading amount of the sheet loaded by the loading tray 302 is a first value, the control section 200 of the erasing apparatus 100 sets the transport amount of the sheet using the assist roller 306 to a first transport amount. When the loading amount of the sheet loaded by the loading tray 302 is a second value that is greater than the first value, the control section 200 of the erasing apparatus 100 sets the transport amount of the sheet using the assist roller 306 to a second transport amount smaller than the first transport amount.

The detection sensor 308 detects the loading amount of the sheet loaded in the loading tray 302. For example, the detection sensor 308 is able to use an angle sensor which detects the rotation angle of the rotation shaft 306*a* of the assist roller 306 or the swing member connected to the rotation shaft 306*a*. When the detection sensor 308 is the angle sensor, the control section 200 may use the value detected by the detection sensor 308 as the loading amount of the sheet in the determination. Alternatively, the control section 200 may calculate the loading amount (the loading height) of the sheet based on the value detected by the detection sensor 308, and may use the calculated value in the determination. Alternatively, the detection sensor 308 may be a sensor that directly detects the loading height of the sheet loaded on the loading tray 302.

The control section 200 controls the transport amount of the sheet using the assist roller 306 based on the loading amount of the sheet detected by the detection sensor 308. Alternatively, the control section 200 may count the number of sheet discharged to the loading tray 302, and may control the transport amount of the sheet based on the count result as the loading amount of the sheet. Hereinafter a circumstance will be described where the angle sensor is used as the detection sensor 308.

Figure 5:
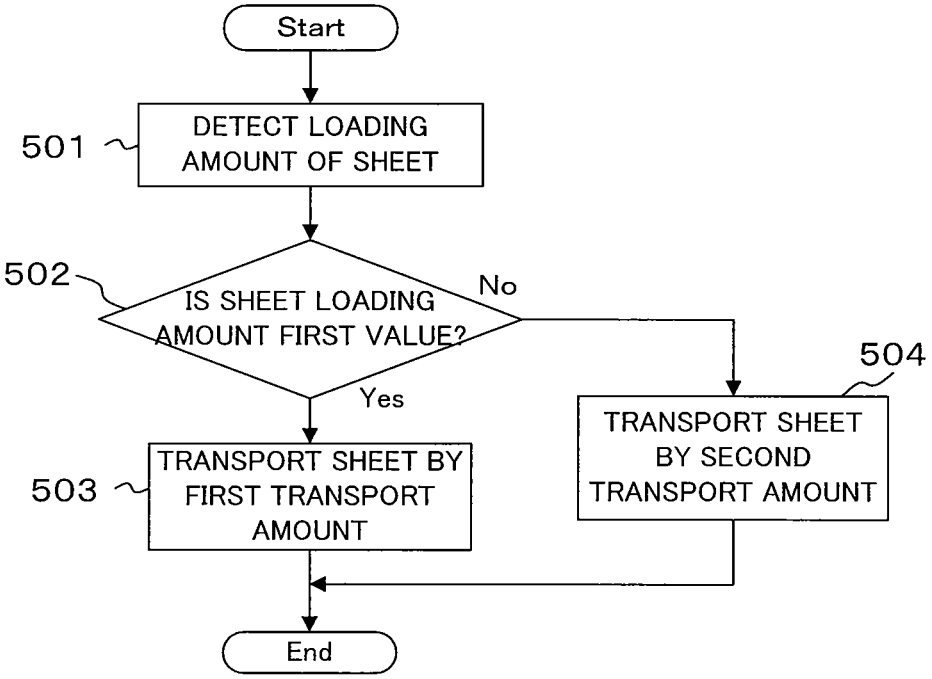
FIG. 5 is a flow chart for describing a sheet discharging control of the erasing apparatus of the first embodiment.

FIG. 5 is a flow chart for describing the sheet discharge control using the control section 200 of the erasing apparatus 100. In 501, the control section 200 detects the loading amount of the sheet loaded by the loading tray 302 via the detection sensor 308. In 502, the control section 200 determines whether or not the loading amount of the sheet is the first value. When the loading amount of the sheet is the first value (Yes of 502), the control section 200 sets the transport amount of the sheet using the assist roller 306 as a first transport amount, and transports the sheet to the stopper 304 side. That is, when the loading amount of the sheet is the first value, the control section 200 drives the drive motor 310 by a first drive amount (a pulse number).

Meanwhile, when the loading amount of the sheet is not the first value (No of 502), that is, when the loading amount of the sheet is the second value that is greater than the first value, the control section 200 sets the transport amount of the sheet using the assist roller 306 as the second transport amount smaller than the first transport amount and transports the sheet to the stopper 304 side. That is, when the loading amount of the sheet is the second value, the control section 200 drives the drive motor 310 by a second drive amount (a pulse number) smaller than the first drive amount.

For example, the control section 200 controls the drive amount (the pulse number) of the drive motor 310 driving the rotation roller 306*c* of the assist roller 306 after detecting the sheet from the detection sensor 134, and controls the transport amount of the sheet. In this case, until the sheet is changed along with an increase in the loading amount of the sheet is discharged from the discharge roller 114 and then abuts against the stopper 304, a distance is considered by which the leading edge of the sheet is moved along the uppermost surface of the loaded sheet. Since the transport position, in which the rotation roller 306*c* of the assist roller 306 comes into contact with the uppermost surface of the sheet loaded on the loading tray 302, is measured by the detection sensor 308, the distance by which the leading edge of the sheet is moved, is defined by the signal detected by the detection sensor 308.

Alternatively, for example, the control section 200 may control the driving amount (the pulse number) in which the drive motor 310 drives the rotation roller 306*c* and may control the transport amount of the sheet after the rotation roller 306*c* abuts against the sheet. The transport position, where the rotation roller 306*c* of the assist roller 306 abuts against the uppermost surface of the sheet loaded on the loading tray 302, can be detected by the signal that is detected by the detection sensor 308. Thus, when firstly receiving the signal indicating that the sheet is detected from the detection sensor 134, the control section 200 transports the sheet up to the transport position by the discharge roller 114 by driving the drive motor 310 by a predetermined pulse number. At the timing when the sheet leading edge is moved to the transport position and the rotation roller 306*c* comes into contact with the discharged sheet, the control section 200 controls the transport amount of the sheet using the rotation roller 306*c* by driving the drive motor 310 by a suitable pulse number and transports the sheet to the stopper 304.

The control section 200 may control the transport amount of the sheet based on the detection sensor 314. When the loading amount of the sheet is a predetermined amount, the detection sensor 314 comes into contact with the sheet to output the detection signal. That is, when the detection sensor 314 does not detect the sheet, the control section 200 determines that the loading amount of the sheet loaded on the loading tray 302 is the first value, and sets the transport amount of the sheet using the assist roller 306 to the first transport amount. Meanwhile, when the detection sensor 314 detects the sheet, the control section 200 determines that the sheet loading amount is the second value that is greater than the first value, and sets the transport amount of the sheet using the assist roller 306 to the second transport amount that is smaller than the first transport amount.

In addition, in the erasing apparatus 100, the matching properties are particularly required in the sheet that is discharged to the first tray 110 or the second tray 112, and in the sheet that is reusable in the image forming device or the like. Meanwhile, in regard to the sheet which is not reused, the matching properties may not be overly required. Thus, when discharging the sheet to the tray that discharges the reusable sheet, the control section 200 may perform the control mentioned above.

The erasing apparatus 100 of the present embodiment includes the discharge roller 114 that discharges the sheet, the loading tray 302 that loads the sheet discharged by the discharge roller 114, the stopper 304 that is provided on the downstream of the loading tray 302 in the sheet discharge direction and abuts against the leading edge of the discharged sheet in the sheet discharge direction, and the rotation roller 306*c* that is provided above the loading tray 302. The rotation roller 306*c* abuts against the upper surface of the sheet discharged from the loading tray 302, and transports the sheet to the stopper 304. Furthermore, the control section 200 of the erasing apparatus 100 controls the transport amount of the sheet using the rotation roller 306*c* based on the loading amount of the loaded sheet.

As mentioned above, in the erasing apparatus 100 of the present embodiment, it is possible to load the sheet discharged to the first tray 110 or the second tray 112 in the state of satisfactory matching properties.

Second Embodiment

After discharging the sheet in the first tray 110 or the second tray 112 of the erasing apparatus 100, by causing the leading edge of the sheet to abut against the stopper 304 by the assist roller 100, the matching properties are enhanced. However, although the sheet matches when being discharged to the first tray 110, when the next sheet is discharged, the transport force is transmitted to the loaded sheet of the uppermost surface due to the friction with the assist roller 306 or the next sheet, and there is a concern that the bucking may be generated in the sheet, and the matching properties may be degraded.

Thus, when there is a next discharged sheet, the erasing apparatus 100 of the second embodiment sets the transport amount of the sheet discharged to the first tray 110 or the second tray 112 to a value that is smaller than the regulated transport amount, and when there is no next discharged sheet, the erasing apparatus 100 sets the transport amount to the described transport amount.

Figure 6A:
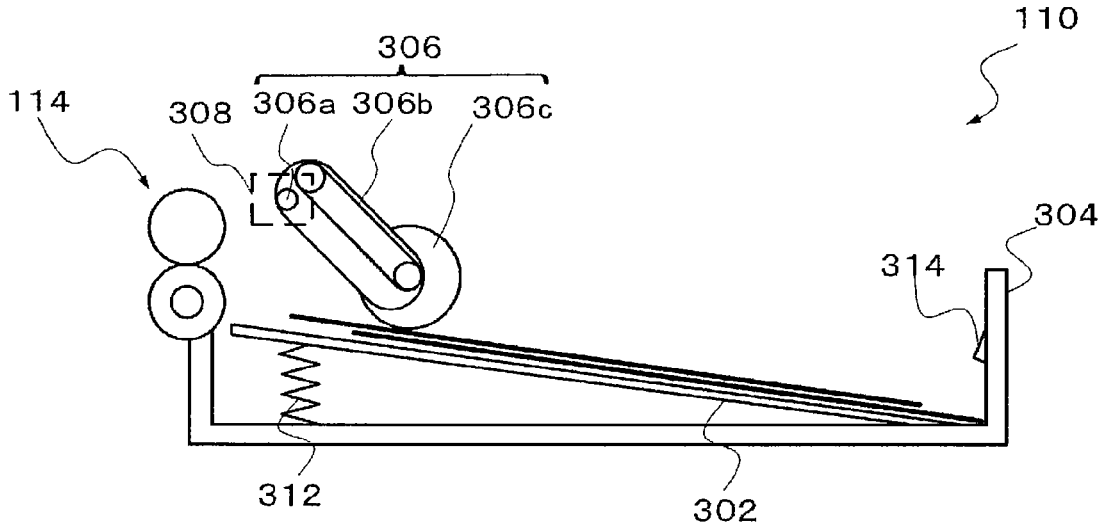
FIGS. 6A and 6B are schematic diagrams for describing the sheet discharging control of the erasing apparatus of a second embodiment.

FIG. 6 is a schematic diagram for describing the paper discharging control of the erasing apparatus 100 of the second embodiment. FIG. 7 is a flow chart for describing a sheet discharging control of the erasing apparatus 100 of the second embodiment. In the present embodiment, the sheet is described as being discharged to the first tray 100.

In Act 701, the control section 200 of the erasing apparatus 100 starts to discharge the sheet to the first tray 110 by the discharge roller 114. In Act 702, when discharging the sheet to the first tray 110, the control section 200 determines whether or not there is a next sheet. For example, when detecting the sheet to be discharged by the detection sensor 134, the control section 200 determines whether or not a sheet is present in the transport path of the upstream in the sheet transport direction or in the paper feeding tray 102. Thus, the sheet to be discharged to the first tray 110 is set to the first sheet or the preceding sheet. On the contrary to the first sheet or the preceding sheet, the next sheet is set to the second sheet or the succeeding sheet. In addition, the control section 200 is not limited to a configuration which simply determines presence or absence of the succeeding sheet. For example, the control section 200 may determine the presence or the absence of the sheet in which the image is read by the reading section 106 after it is determined whether or not the reuse is possible and which is determined to be discharged to the first tray 110 subsequently to the preceding sheet (the first sheet), as the succeeding sheet (the second sheet).

When it is determined that there is a succeeding sheet (Yes of Act 702), the control section 200 transports the sheet by setting the transport amount of the sheet discharged by the discharge roller 114 and the assist roller 306 as the third discharge amount (Act 703). The third transport amount becomes the transport amount smaller than a predetermined transport amount in which the leading edge of the sheet discharged to the loading tray 302 reaches the stopper 304. That is, the control section 200 drives the drive motor 310 by the third drive amount (the pulse number). After transporting the sheet by the third transport amount, the control section 200 separates the assist roller 306 from the discharged sheet or stops the driving of the rotation roller 306*c* of the assist roller 306 (see FIG. 6A). When stopping the driving of the rotation roller 306*c*, it is desirable to separately place the drive motors of the discharge roller 114 and the rotation roller 306*c*. The sheet is stopped before the leading edge of the sheet abuts against the stopper 304. The position where the sheet is stopped is a stop position before matching.

Next, the control section 200 starts to discharge the succeeding sheet to the first tray 110 by the discharge roller 114 (Act 704). The control section 200 proceeds to the processing of Act 702 and determines whether or not there is the succeeding sheet.

Meanwhile, in 702, when discharging the preceding sheet (the first sheet), if it is determined that there is no succeeding sheet (No of Act 702), the control section 200 transports the sheet by setting the transport amount of the sheet discharged by the discharge roller 114 and the assist roller 306 to a fourth transport amount greater than the third transport amount (Act 705). The fourth transport amount becomes a predetermined transport amount in which the leading edge of the sheet discharged to the loading tray 302 reaches the stopper 304. That is, the control section 200 drives the drive motor 310 by the fourth drive amount (the pulse number). Thus, the finally discharged sheet collides with the stopper 304, and thus matches.

Figure 6B:
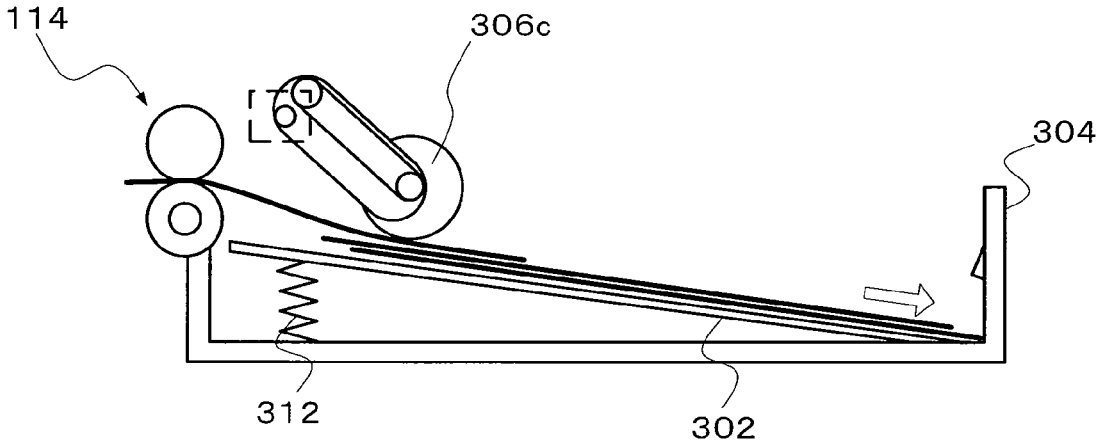
Figure 7:
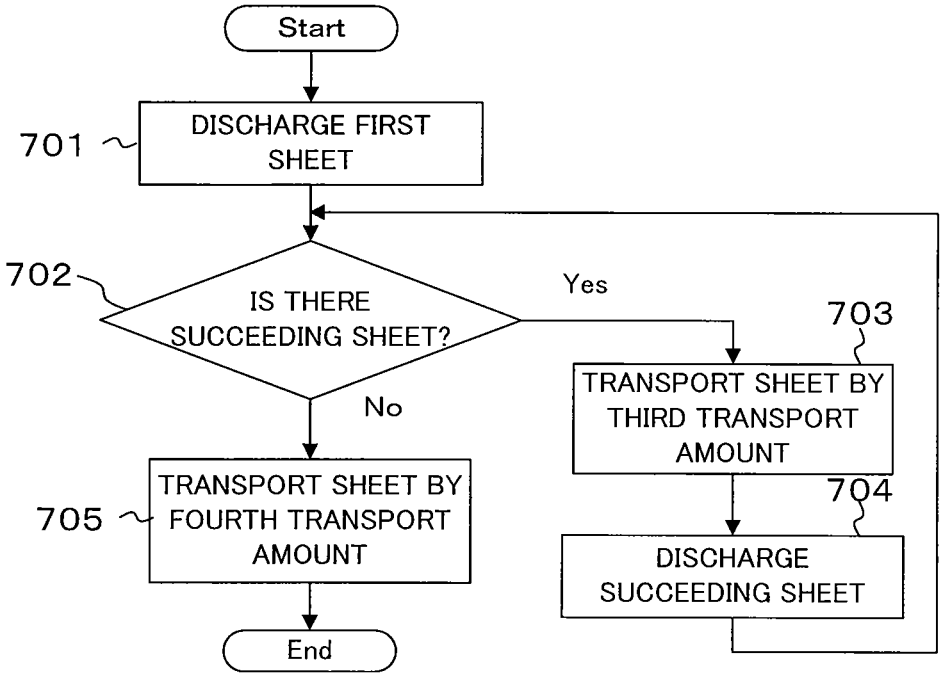
FIG. 7 is a flowchart for describing a sheet discharging control of the erasing apparatus of the second embodiment.

Furthermore, when the succeeding sheet is discharged, the rotational force of the assist roller 306 or the transport drive by the friction with the succeeding sheet is transmitted to the sheet loaded on the loading tray 302 in advance, that is, the sheet stopped in the stop position before the matching, and the sheet crashes into the stopper 304 earlier than the succeeding sheet (FIG. 6B). Since the succeeding sheet is superimposed on the sheet which firstly crashes into the stopper 304, the warping, the buckling, the rebounding or the like is hardly generated after crushing into the stopper 304.

For example, when the suitable transport amount of the sheet for the matching using the assist roller 306 is L1, if there is a succeeding sheet, when the prior sheet is discharged, the transport amount L2 smaller than L1 is set. When the transport amount from starting the discharge of the succeeding sheet until the succeeding sheet reaches the assist roller 306 is L3, the transport amount L2 becomes L2+L3≅L1.

According to the erasing apparatus 100 of the second embodiment, it is possible to load the sheet discharged to the first tray 110 or the second tray 112 which are the paper discharge tray with good matching properties.

In addition, the erasing apparatus 100 of the second embodiment controls the sheet transport amount based on the presence or the absence of the succeeding sheet, but is not limited thereto. For example, the control section 200 may always transport the discharged sheet by the transport amount smaller than a predetermined transport amount in which the leading edge of the sheet reaches the stopper 304.

Furthermore, naturally, the combination of the erasing apparatus 100 of the second embodiment and the erasing apparatus 100 of the first embodiment may also be adopted. That is, when discharging the sheet, the control section 200 determines whether or not there is the succeeding sheet of the sheet. When there is no succeeding sheet, the control section 200 sets the transport amount (for example, the drive amount of the drive motor) of the sheet to anyone of the first transport amount or the second transport amount, based on the loading amount (or the height) of the sheet. When there is the succeeding sheet, the control section 200 sets the transport amount of the sheet to the transport amount smaller than the first transport amount or the second transport amount defined based on the sheet loading amount.

For example, when the loading amount of the sheet loaded on the loading tray 302 is the first value and there is no succeeding sheet, the control section 200 sets the transport amount of the sheet using the assist roller 306 to the first transport amount in which the leading edge of the sheet suitably crashes into the stopper 304. When the loading amount of the sheet is the second value that is greater than the first value and there is no succeeding sheet, the control section 200 sets the transport amount of the sheet using the assist roller 306 to the second transport amount smaller than the first transport amount. The second transport amount is the transport amount in which the leading edge of the sheet suitably crashes into the stopper 304. Furthermore, when the loading amount of the sheet is the first value and there is the succeeding sheet, the control section sets the transport amount of the sheet using the assist roller 306 to the third transport amount smaller than the first transport amount. The third transport amount is the transport amount in which the leading edge of the sheet is stopped before crashing into the stopper 304, when the loading amount of the sheet is the first value. Furthermore, when the loading amount of the sheet is the second value and there is a succeeding sheet, the control section 200 sets the transport amount of the sheet using the assist roller 306 to the fourth transport amount smaller than the second transport amount. The fourth transport amount is the transport amount in which the leading edge of the sheet is stopped before crashing into the stopper 304, when the loading amount of the sheet is the second value.

Third Embodiment

The erasing apparatus 100 of the third embodiment will be described. In the erasing apparatus 100 of the third embodiment, the sheet transport speed of the discharge roller 114 which discharges the sheet to the loading tray 302 is different from the sheet transport speed of the assist roller 306 which transports the sheet discharged by the discharge roller 114 to the stopper 304.

For example, in order to enhance the productivity, the transport speed (the rotation speed) of the discharge roller 114 is highly set. On the contrary, when the transport speed (the rotation speed) of the assist roller 306 is equal to the transport speed of the discharge roller 114, if the speed at which the leading edge of the sheet crashes into the stopper 304 is too fast, there is a concern that the buckling may occur in the sheet and the matching properties may be damaged.

Thus, the control section 200 of the erasing apparatus 100 drives the discharge roller 114 at the first transport speed, and drives the assist roller 306 at the second transport speed slower than the first transport speed. In addition, the control section 200 may have a configuration in which the control section 200 transports the sheet by the assist roller 306 at the first transport speed and changes the transport speed to the second transport speed before the leading edge of the sheet crashes into the wall of the paper discharge tray.

According to the erasing apparatus 100 of the third embodiment, it is possible to load the sheet discharged to the first tray 110 or the second tray 112 which is the paper discharge tray in the state of the good matching properties.

According to at least one embodiment mentioned above, it is possible to improve the loading properties of the sheet that is output to the discharge section.

In the above descriptions of the embodiments, the "color erasing processing" was described to mean that the color of the images formed on a sheet is erased, but may include the meaning that an image is erased. Namely, the color erasing apparatus explained in the embodiments should not be limited to an apparatus that erases a color of an image by heating. For example, the erasing apparatus may be either an apparatus that erases a color of an image on a sheet by irradiating light on the image or an apparatus that erases an image formed on a special sheet. Alternatively, the erasing apparatus may be an apparatus that removes an image on a sheet. The erasing apparatus only has to have a configuration for making an image invisible in order to make a sheet reusable.

An entity that executes the operations in the embodiments is an entity related to a computer such as a hardware, a complex of the hardware and software, the software, and the software being executed. The entity that executes the operations is a process executed on a processor, the processor, an object, an execution file, a thread, a computer program, and the computer but is not limited to these. The process or the thread may be caused to play plural entities that execute the operation.

While certain embodiments have been described, these embodiments have been presented by way of example only, and are not intended to limit the scope of invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. A sheet loading apparatus comprising:

a discharge member which discharges a sheet;

a loading member which loads the sheet discharged by the discharge member;

a tip support member which is provided in the downstream of the loading member in a sheet discharge direction and abuts against the leading edge of the sheet discharged by the discharge member in the sheet discharge direction;

a rotation member which is provided above the loading member, abuts against an upper surface of the sheet discharged to the loading member, and is rotated to transport the sheet to the tip support member side; and a control section which controls a transport amount of the sheet through the rotation member based on a loading amount of sheets loaded on the loading member, wherein the loading amount is detected by a detection member;

wherein, when the loading amount of sheets loaded on the loading member is a first value, the control section sets the transport amount to a first transport amount, and when the loading amount is a second value that is greater than the first value, the control section sets the transport amount to a second transport amount smaller than the first transport amount;

wherein when discharging a sheet, the control section determines whether or not there is a succeeding sheet to the sheet, the control section sets the transport amount to any one of the first transport amount or the second transport amount based on the loading amount of sheets when there is no succeeding sheet, and the control section sets the transport amount to a transport amount smaller than the first transport amount or the second transport amount defined based on the loading amount of sheets when there is a succeeding sheet.

2. The apparatus according to claim 1, further comprising: a swing member which includes the rotation member in one end thereof and is rotationally moved around a rotation shaft, wherein the detection member detects a rotation angle of the swing member in a state where the sheet loaded on the loading member abuts against the rotation member as the loading amount, and the control section controls the transport amount based on the value of the detected rotation angle.

3. The apparatus according to claim 1, wherein the detection member detects the height of the sheet loaded on the loading member as the loading amount.

4. The apparatus according to claim 3, wherein the detection member is provided in the tip support member, and detects the sheet on the loading member when the height of the sheet is equal to or greater than the second value.

5. The apparatus according to claim 3, wherein the control section sets the drive amount to the first drive amount when the height of the sheet is the first value, and the control section sets the drive amount to the second drive amount when the height of the sheet is the second value.

6. The apparatus according to claim 1, further comprising: a drive motor that drives the rotation member, wherein the transport amount is a drive amount of the drive motor, the control section sets the drive amount to a first drive amount when the loading amount is the first value, and the control section sets the drive amount to a second drive amount smaller than the first drive amount when the loading amount is the second value.

7. The apparatus according to claim 1, wherein the rotation member is a sponge roller.

8. The apparatus according to claim 7, wherein the loading member slopes along the sheet discharge direction so that the tip support member side is lowered.

9. The apparatus according to claim 1, further comprising:

an erasing section which is placed in the upstream of the discharge member in a sheet transport direction, and erases an image of the transported sheet.

10. The apparatus according to claim 9, further comprising:

a reading section which reads the sheet in which the image is erased by the erasing section, wherein of the sheets, the control section loads the sheet determined to be reusable, which is read by the reading section, to the loading section.

11. A sheet loading method of discharging a sheet to a loading member, and causing the sheet discharged by a rotation member abutting against an upper surface of the discharged sheet to collide with and match with a tip support member provided in the downstream of the loading member in a sheet discharge direction, the method comprising:

detecting, by a detection member, a loading amount of sheets loaded on the loading member;

transporting the sheet to the tip support member by setting the transport amount through the rotation member to a first transport amount when the loading amount of sheets loaded on the loading member is a first value; and transporting the sheet to the tip support member by setting the transport amount through the rotation member to a second transport amount smaller than the first transport amount when the loading amount of sheets loaded on the loading member is a second value that is greater than the first value;

wherein, when the loading amount of sheets is the first value, the transport amount is set to the first transport amount, and when the loading amount is the second value that is greater than the first value, the transport amount is set to the second transport amount smaller than the first transport amount;

wherein it is determined, by a control section, whether or not there is a succeeding sheet of the sheet when discharging the sheet, the transport amount is set to any one of the first transport amount or the second transport amount based on the loading amount of sheets when there is no succeeding sheet, and the transport amount is set to a transport amount smaller than the first transport amount or the second transport amount defined based on the loading amount of sheets when there is the succeeding sheet.

12. The method according to claim 11, wherein the height of the sheet loaded on the loading member is detected as the loading amount, the drive amount is set to the first drive amount when the height of the sheet is the first value, and the drive amount is set to the second drive amount when the height of the sheet is the second value.

13. The method according to claim 11, wherein an image of the transported sheet is erased by an erasing section before discharging the sheet to the loading member.

14. The method according to claim 13, wherein the sheet determined to be reusable of the sheet, which is read by the reading section, is loaded onto the loading section.

15. A color erasing apparatus comprising:

an erasing section which erases an image of a transported sheet;

a discharge member which discharges the sheet in which the image is erased by the erasing section;

a loading member which loads the sheet discharged by the discharge member;

a tip support member which is provided in the downstream of the loading member in a sheet discharge direction and abuts against the leading edge of the sheet in a sheet discharge direction discharged by the discharge member;

a rotation member which is provided above the loading member, abuts against an upper surface of the sheet discharged to the loading member, and is rotated to transport the sheet to the tip support member side; and a control section which controls a transport amount of the sheet through the rotation member based on a loading amount of sheets loaded on the loading member, wherein the loading amount is detected by a detection member;

wherein, when the loading amount of sheets loaded on the loading member is a first value, the control section sets the transport amount to a first transport amount, and when the loading amount is a second value that is greater than the first value, the control section sets the transport amount to a second transport amount smaller than the first transport amount;

wherein when discharging a sheet, the control section determines whether or not there is a succeeding sheet to the sheet, the control section sets the transport amount to any one of the first transport amount or the second transport amount based on the loading amount of sheets when there is no succeeding sheet, and the control section sets the transport amount to a transport amount smaller than the first transport amount or the second transport amount defined based on the loading amount of sheets when there is a succeeding sheet.

* * * * *